US008936438B2

(12) United States Patent
Fucks et al.

(10) Patent No.: US 8,936,438 B2
(45) Date of Patent: Jan. 20, 2015

(54) ROTOR BLADE PITCH ADJUSTING DEVICE AND TURBOMACHINE CONTAINING THE SAME

(75) Inventors: Thomas Fucks, Röthlein (DE); Jean Pierre Grattler, Saint Albert Leysee (FR); Laurent Benoit, La Chavanne (FR)

(73) Assignee: Antiebolaget SKF, Gothenburg (SE)

( * ) Notice: Subject to any disclaimer, the term of this patent is extended or adjusted under 35 U.S.C. 154(b) by 756 days.

(21) Appl. No.: 13/117,243

(22) Filed: May 27, 2011

(65) Prior Publication Data

US 2011/0293426 A1 Dec. 1, 2011

(30) Foreign Application Priority Data

May 29, 2010 (DE) ..... 10 2010 021 988

(51) Int. Cl.

| | |
|---|---|
| ***F03D 7/04*** | (2006.01) |
| ***F01D 7/00*** | (2006.01) |
| ***F04D 29/36*** | (2006.01) |
| ***F04D 29/32*** | (2006.01) |

(52) U.S. Cl.

CPC ..... *F01D 7/00* (2013.01); *F04D 29/362* (2013.01); *F04D 29/323* (2013.01)

USPC ..... 416/162; 416/163; 416/165; 416/168 R

(58) Field of Classification Search

USPC ..... 416/147, 162, 163, 164, 165, 166, 416/168 R, 132 B, 133

See application file for complete search history.

(56) References Cited

U.S. PATENT DOCUMENTS

| | | | | |
|---|---|---|---|---|
| 4,183,715 | A * | 1/1980 | Ducker | 416/41 |
| 2010/0143131 | A1* | 6/2010 | Pitre | 416/85 |

FOREIGN PATENT DOCUMENTS

| | | | |
|---|---|---|---|
| DE | 33822 | A1 | 11/1964 |
| DE | 3619406 | A1 | 12/1987 |

* cited by examiner

*Primary Examiner* — Edward Look
*Assistant Examiner* — Juan G Flores
(74) *Attorney, Agent, or Firm* — Bryan Peckjian; SKF USA Inc. Patent Department

(57) ABSTRACT

An adjusting device is provided for pivoting blades of a rotor via a transmission that is actuatable by a co-rotating, axially-displaceable actuating shaft. The adjusting device includes a roller bearing having a first side or ring that is attachable to the actuating shaft and a second side or ring connected with an actuating body that is non-rotatably supported in a support body. The adjusting device further includes a screw drive that axially displaces the actuating body within the support body to thereby linearly actuate the transmission.

18 Claims, 2 Drawing Sheets

ROTOR BLADE PITCH ADJUSTING DEVICE AND TURBOMACHINE CONTAINING THE SAME

CROSS-REFERENCE

This application claims priority to German patent application no. 10 2010 021 988.6 filed on May 29, 2010, the contents of which are incorporated herein by reference.

TECHNICAL FIELD

The invention generally relates to an adjusting device for changing the rotational position or pitch of one or more blades of a rotor, e.g., of a wind turbine, via a transmission that is actuatable by an actuating shaft, which rotates together with the rotor and is axially displaceable relative to the rotor. The adjusting device includes a roller bearing having a first side or ring that is attachable to the actuating shaft and a second side or ring that is connected with an actuating body. A support body supports the actuating body in a non-rotatable manner, but permits axial displacement of the actuating body relative to the support body.

BACKGROUND ART

DE 36 19 406 A1 discloses an adjusting device for adjustable rotor blades, in particular of a turbine or a propeller pump. With reference to the drawings of DE 36 19 406 A1, the known adjusting device includes a machine shaft 2 and an actuating shaft 6, via which the position or pitch of the rotor blades, which are rotatably disposed in a hub, is adjustable using a hydraulically-actuated piston 40. The actuating shaft 6 is rotatable with the machine shaft 2, but is axially displaceable relative to the machine shaft 2. A bearing 14 supports the actuating shaft 6 so that it is rotatable relative to the hydraulically-actuated piston 40. An actuating cylinder 42 accommodates the axially-displaceable piston 40 and is disposed on a machine housing in a stationary manner.

SUMMARY

In one aspect of the present teachings, an adjusting device is taught that is capable of providing an improved linear actuation of an actuating shaft.

In another aspect of the present teachings, an adjusting device is provided for actuating a transmission that adjusts the rotational position or pitch of one or more blades of a rotor. The transmission is actuatable by an actuating shaft that rotates together with the rotor, but is axially-displaceable relative to the rotor. The adjusting device includes a roller bearing having one side (e.g., a first bearing ring) configured to be attached to the actuating shaft and another side (e.g., a second bearing ring) connected with an actuating body that is supported in a support body so as to be axially displaceable, but rotationally-fixed (non-rotatable). The adjusting device further comprises a screw drive configured to axially displace the actuating body that is supported in the support body.

As utilized herein, the term "screw drive" is intended to encompass mechanical linear actuators configured or adapted to convert or translate a turning, pivoting or rotating motion into linear motion utilizing at least two helically-threaded structural elements. Representative examples of suitable screw drives include, but are not limited to, a lead screw, a power screw, a translation screw, a ball screw, a roller screw, a planetary roller screw and a satellite roller screw. Generally speaking, the screw drive may preferably include a first element that comprises, e.g., a bolt or screw having an outer thread that is rotatably driven by a motor having a rotatable output drive shaft. A second element includes an inner thread disposed around or at least adjacent to the outer thread of the first element. Rotation of the first element causes the second element to displace in the axial direction relative to the first element and this movement in the axial direction is imparted to the actuating shaft, as will be further discussed below. Naturally, the arrangement of the threads on the first and second elements may be interchanged or reversed, such that, e.g., the element having the inner thread is rotatably driven by the motor and the element having the outer thread is axially displaceable relative to the element with the inner thread.

The above-described screw drive can be operated at least substantially dry, i.e. no fluids are necessary in order to actuate the actuating shaft, which is particularly advantageous in applications of the present teachings, in which environmental contamination or pollution caused by leaking fluids (e.g., hydraulic fluids or oils) must be prevented or at least substantially eliminated.

In addition or in the alternative, such a screw drive can be constructed with a relatively narrow diameter, so that it can minimize space requirements and can even be utilized inside of relatively narrow hollow shafts.

Furthermore, even though such screw drives may have a relatively small construction, it is still possible to transmit relatively large linear actuating forces.

In one embodiment, the actuating body can include an inner thread. A complementary outer thread of a lead screw engages the inner thread. The lead screw is retained at a bearing point of the support body so as to be rotatable, but the lead screw is not axially displaceable. The lead screw includes a driven part that is connectable to a rotary drive (e.g., motor with a rotatable output shaft). The rotary drive can thus drive (rotate) the lead screw, whereby the actuating body is moved in the axial direction by the rotational movement of the lead screw. However, in an inverse variant, the actuating body can instead have the outer thread and a pipe-shaped shaft having an inner thread can be driven by the rotary drive. In another alternative, the actuating body can comprise a nut, in which the inner thread is formed.

The lead screw and the actuating shaft can be oriented along the same rotational axis. In this case, the axial actuating forces can be transmitted to the actuating shaft from the actuating body and/or the lead screw in a stress-free manner.

The axially-fixed lead screw can be rotatably supported at one terminal end of a hollow circular cylindrical support body. The lead screw is thus axially fixed in the support body, i.e. the axial positions of the lead screw and the support body are rigid or immovable. The lead screw is supported on the support body so that it is only rotatable.

The lead screw can be supported at the bearing point (terminal end) of the support body, e.g., by a roller bearing. Representative examples of suitable roller bearings include, but are not limited to, a two-row tapered roller bearing, a spherical roller bearing and two angular contact roller bearings, e.g., disposed in a back-to-back arrangement (also known as an "O" arrangement).

In all of the above-noted embodiments, the lead screw may optionally have a free end that projects into a recess of the support body.

In addition or in the alternative, the actuating shaft can have a terminal-end cavity, e.g., an axial bore, for the insertion of the free end of the lead screw. That is, the cavity or axial bore is preferably connected to the recess of the support body and allows the actuating shaft to axially displace relative to the lead screw without contacting the free end of the lead screw.

In such an embodiment, a structure can be achieved, in which the adjusting device has a relative compact axial length or extension.

In a further development, the actuating body can include a radial projection that engages in an axial groove of the support body. The engagement of the radial projection in the axial groove of the non-rotatable support body prevents the actuating body from rotating together with the lead screw when the lead screw rotates. Instead of a single projection, the actuating body may have a plurality of radial projections that all engage in a common axially-extending groove. In the alternative, the support body may have a plurality of axially-extending grooves, each one engaging a respective radial projection. In the latter embodiment, the plurality of axially-extending grooves could be, e.g., distributed equal-distantly from each other around the inner circumference of the support body. In this case, the projections would extend radially outward into the associated axially-extending grooves at equal-distant spacings around the outer circumference of the actuating body. The arrangement of the projection(s) and groove(s) may be reversed, such that the actuating body has one or more grooves and the support body has one or more projections. The actuating body and the support body can also be formed, e.g., in the shape of a spline shaft profile.

In an additional design, the actuating body can have a cavity that retains a lead screw nut, which thus forms or provides the inner thread of the actuating body. The lead screw nut can be, e.g., connected with the actuating body by an interference-fit or a friction-fit. For example, the lead screw nut can be press-fit into the actuating body. In the alternative, the inner thread can be, e.g., cut directly into the actuating body.

In certain applications of the present teachings, any of the above- or below-described adjusting devices can be used, e.g., in an inking station or dampening (wetting) station of a printing press.

In other applications of the present teachings, any of the above- or below-described adjusting devices may be utilized in a turbomachine, such as a pump, compressor, turbine or turbine generator, which includes a rotor with blades and a transmission for adjusting the position or pitch of the blades. The transmission is actuatable by a co-rotating, axially-displaceable actuating shaft that is linearly displaced by an adjusting device according to the present teachings. Presently preferred applications of the present teachings include, but are not limited to, wind turbines, gas turbines, steam turbines and industrial ventilators.

In summary, inventive solutions are taught herein for the linear displacement of a rotating shaft, and particularly for adjusting (rotating) a position (pitch) of rotor blades relative to the rotational axis of the rotor. For example, in certain embodiments of the present teachings, adjusting devices are disclosed that can avoid or prevent fluid leakages, because a hydraulic system is not necessary. Instead, a mechanical linear actuator is utilized that operates without fluids and/or hydraulic liquids, such as, e.g., oil. Such an adjusting device can be characterized as a "dry system" and can be advantageously utilized in applications disposed above or near water where fluid leakages could lead to contamination of the surrounding water, such as off-shore wind turbines. In certain embodiments of the present teachings, the adjusting device is distinguished by exhibiting good controllability. Furthermore, adjusting devices according to the present teachings can be operated very economically, because energy for the blade pitch adjustment is necessary only during an adjusting movement (linear actuation that is converted into rotation of the blade about its pivot axis).

Further objects, aspects, advantageous and elements of the present teachings will become apparent to the skilled person after reading the following description and appended claims in view of the attached drawings.

DETAILED DESCRIPTION OF EMBODIMENTS OF THE INVENTION

Figure 1:
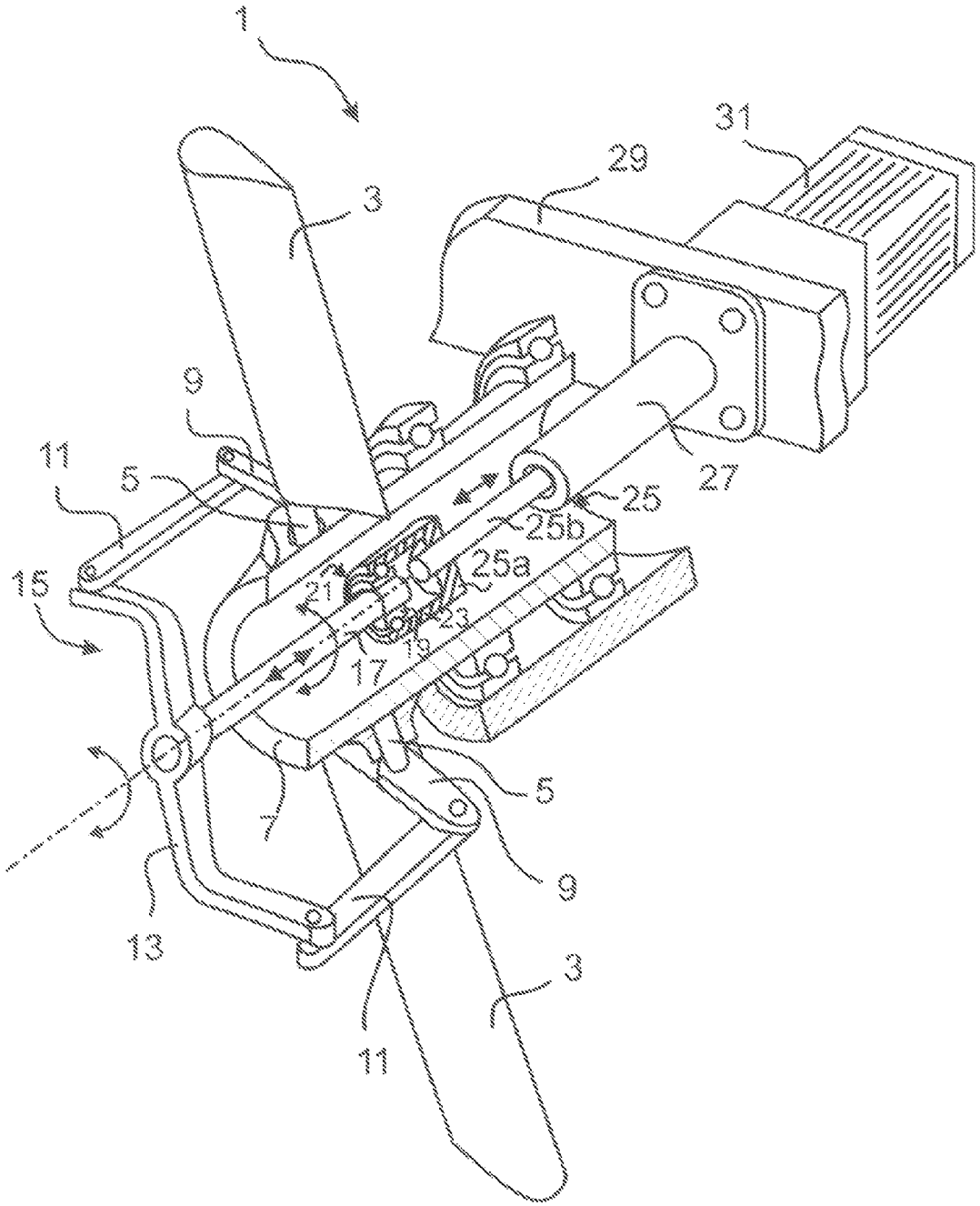
FIG. 1 shows a perspective view of a first embodiment of an adjusting device according to the present teachings.

A turbine rotor 1 is depicted in FIG. 1 as a representative turbomachine or turbomachinery that includes two blades 3 as an example. However, another number (e.g., 3 or more) of blades 3 could also be provided in modifications of this embodiment. Each blade 3 is pivotably supported on a rotor shaft 7 via a pivot axle 5. One arm 9 is connected with each pivot axle 5 and/or with each blade 3. The two arms 9 are each respectively connected with a common fork 13 via a connecting rod 11. The two arms 9, the two connecting rods 11 and the common fork 13 form a transmission 15, by which the position or pitch (i.e. a pivotal position) of the blades 3 can be changed and/or adjusted. That is, the pivot axle 5 is pivoted by the transmission 15.

As used herein, the term "transmission" is intended to encompass any type of mechanism configured or adapted to convert linear motion into rotational or pivoting motion. Representative examples of suitable transmissions include, but are not limited to, a Scotch yoke, a crank mechanism and a crank-slide mechanism. It is preferred that the transmission includes a first portion of a structural element that is linearly or axially movable by the actuating shaft (as will be further described below) and this linear motion is converted into pivotal movement of the rotor blade 3 about its pivot axis, which is perpendicular to the rotational axis of the actuating shaft 17. By pivoting the rotor blade 3 about its pivot axis, the rotational position or pitch of the rotor blade 3 can be changed or adjusted.

Thus, the transmission 15 is linearly actuated by the axially-displaceable actuating shaft 17. During operation of the turbomachine, the transmission 15 rotates together with the blades 3, the rotor shaft 7 and the actuating shaft 17 about the rotational axis D. Thus, the actuating shaft 17 is both rotatable and axially displaceable in order to be able to change and/or adjust the position (pitch) of the blades 3.

For reference purposes, it is noted that the actuating shaft 17 is axially displaceable relative to a stationary, i.e. not co-rotating, reference point 29, e.g., a mounting or support plate. In order to achieve the combined rotational and axial movement, an inner ring 19 of a roller bearing 21 sits on the actuating shaft 17 at the end of the actuating shaft 17 that is opposite of the transmission 15. Preferably, the inner ring 19 is axially-fixed relative to the actuating shaft 17 by being disposed within a circumferentially-extending groove defined in the outer surface of the actuating shaft 17. An outer ring 23 of the roller bearing 21 is connected with an actuating body 25, e.g., by being disposed in a circumferentially-extending groove defined in the inner surface of the actuating body 25. In the embodiment depicted in FIG. 1, the actuating body 25 includes a pot 25*a* and a rod 25*b*. The pot 25*a* is preferably a hollow cylinder with one end that is partially closed and/or fixedly connected to the rod 25*b*. Further, the rod 25*b* is not rotatable, but is movable in the axial direction relative to the reference point 29.

Due to the rotational decoupling provided by the roller bearing 21, the rotating actuating shaft 17 can be axially (linearly) moved by the not-rotating actuating body 25. That is, the actuating body 25 is supported in a support body 27 so as to be rotationally fixed. The actuating body 25 is thus axially displaceable relative to the support body 27, but is supported so as to be non-rotatable relative to the support body 27. The support body 27 is rigidly affixed to the stationary reference point (mounting plate) 29. Torque is supplied to the adjusting device by a rotary drive (motor) 31, which is also fixed in a stationary manner, i.e. it does not co-rotate with the turbine rotor 1 and/or with the rotor shaft 7.

Figure 2:
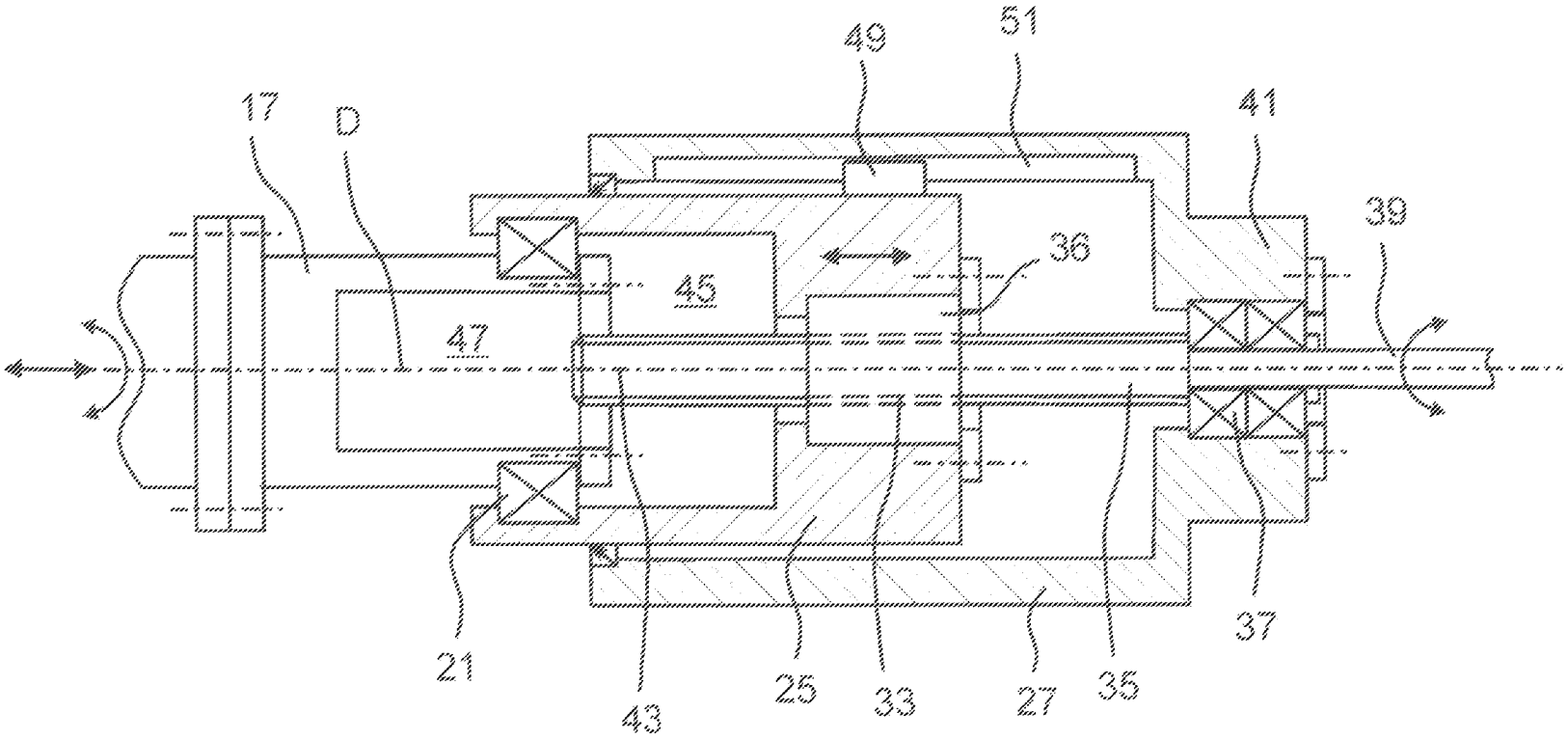
FIG. 2 shows a cross-sectional view of a second embodiment of an adjusting device according to the present teachings.

A modified embodiment of the actuator device is shown in FIG. 2. In this modified embodiment, the actuating body 25 includes an inner thread 33 that is engaged with, and is axially movably guided along, a lead screw 35. The actuating body 25 may optionally include a recess for a lead screw nut 36 that forms or provides the inner thread 33 of the actuating body 25. In the alternative, the inner thread 33 may be formed directly on the inner surface of the actuating body 25. The lead screw 35 is rotatably supported at a bearing point 37 of the support body 27, but it is not movable or displaceable in the axial direction. The lead screw 35 has a driven part (shaft) 39, to which the rotary drive 31 is connectable.

In the embodiment illustrated in FIG. 2, the lead screw 35 and the actuating shaft 17 are oriented and extend in series along the same rotational axis D. The lead screw 35 is rotatably supported at one terminal end 41 of the support body 27 so as to be axially fixed, i.e. it does not move in the axial direction. In this exemplary embodiment, the support body 27 is a hollow circular cylinder having one end that is partially closed and/or constricted to receive the bearing 37. The lead screw 35 has a free end 43 that projects into a recess 45 defined within the actuating body 25. The actuating shaft 17 has a terminal-end cavity 47, e.g., an axial bore, for the insertion of the free end 43 of the lead screw 35. That is, the free end 43 of the actuating shaft 17 and the cavity 47 thus form a telescoping arrangement (e.g., a telescopic cylinder), which provides a relatively compact overall axial length when the actuating shaft 17 is fully retracted towards the reference point 29.

The actuating body 25 has at least one radial projection 49, e.g., in the form of a fitted key or spline, which engages in at least one axial groove 51 defined in the support body 27. The actuating body 27 is axially displaceable while being supported in a rotationally-fixed (non-rotatable) manner in the support body 27 due to the engagement of the projection(s) 49 and the axial groove(s) 51.

In an alternative embodiment, the support body 27 can instead have a polygonal cross-section, such as a rectangle, a square or a triangle. In such an embodiment, the outer surface of the actuating body 25 preferably has a corresponding or complementary polygonal shape, so that rotation of the actuating body 25 relative to the support body 27 is prevented by the complementary (nested) shapes.

In addition or in the alternative, a second roller bearing may be provided within the cavity 47 of the actuating shaft 17 to rotatably support the free end 43, thereby preventing the free end 43 from vibrating or oscillating during operation. In such an embodiment, the roller bearing is preferably axially displaceable relative to the actuating shaft 17, so that axial movement of the actuating shaft 17 relative to the lead screw 35 can be compensated.

REFERENCE NUMBER LIST

1 Turbine rotor
3 Blade
5 Pivot Axle
7 Rotor Shaft
9 Arm
11 Connecting rod
13 Fork
15 Transmission
17 Actuating shaft
19 Inner ring
21 Roller bearing
23 Outer ring
25 Actuating body
27 Support body
29 Reference point (mounting plate)
31 Rotary drive (motor)
33 Inner thread
35 Lead screw
36 Lead screw nut
37 Bearing point
39 Driven part
41 Terminal end
43 Free end
45 Recess
47 Cavity
49 Projection
51 Axial groove
D Rotational axis

The invention claimed is:

1. An adjusting device for blades each located on a pivot axle connected to a rotor shaft such that the blades can rotate about a rotational axis, an actuating shaft extending through the rotor shaft, comprising:

the actuating shaft configured for axial movement along the rotational axis;

a transmission disposed on the actuating shaft and configured to adjust a pitch of the blades while maintaining the pivot axle of each of the blades oriented perpendicular to the rotational axis, the transmission being configured to adjust the pitch of the blades when the transmission is axially moved along the rotational axis by the actuating shaft;

a first roller bearing having a first side engaged with the actuating shaft and a second side;

an actuating body engaged with the second side of the first roller;

a support body supporting the actuating body in a non-rotatable manner; and a screw drive configured to axially displace the actuating body along the rotational axis relative to the support body.

2. An adjusting device according to claim 1, wherein the actuating body includes an inner thread, a complementary thread of a lead screw engages the inner thread, the lead screw is rotatably supported at a bearing point of the support body, but is fixed in the axial direction, and the lead screw includes a driven part, to which a rotary drive is connectable.

3. An adjusting device according to claim 2, wherein the lead screw and the actuating shaft are oriented in series along a common rotational axis.

4. An adjusting device according to claim 3, wherein the bearing point that rotatably supports the lead screw is located at a terminal end of the support body, which is substantially hollow circular cylindrical-shaped.

5. An adjusting device according to claim 4, wherein the bearing point of the support body comprises a second roller bearing selected from the group consisting of: a two-row tapered roller bearing, a spherical roller bearing and two angular contact roller bearings disposed in a back-to-back arrangement.

6. A turbomachine, comprising:

a rotor having blades that are pivotable about respective pivot axes, a transmission configured to pivot the blades about the respective pivot axes, an axially-displaceable actuating shaft configured rotate together with the transmission and to actuate the transmission so as to cause the blades to pivot, and the adjusting device according to claim 1 configured to axially displace the actuating shaft.

7. An adjusting device for blades of a rotor that includes a transmission for adjusting the blades, the transmission being actuatable by a co-rotating, axially-displaceable actuating shaft, the adjusting device including:

a first roller bearing having a first side configured to be attached to the actuating shaft and a second side connected with an actuating body, a support body supporting the actuating body in a non-rotatable manner, and a screw drive configured to axially displace the actuating body relative to the support body, wherein the actuating body includes an inner thread, a complementary thread of a lead screw engages the inner thread, the lead screw is rotatably supported at a bearing point of the support body, but is fixed in the axial direction, the lead screw includes a driven part to which a rotary drive is connectable, the lead screw and the actuating shaft are oriented in series along a common rotational axis, wherein the bearing point that rotatably supports the lead screw is located at a terminal end of the support body, which is substantially hollow circular cylindrical-shaped, the bearing point of the support body comprises a second roller bearing selected from the group consisting of: a two-row tapered roller bearing, a spherical roller bearing and two angular contact roller bearings disposed in a back-to-back arrangement, and wherein the lead screw has a free end that projects into a recess defined in the support body.

8. An adjusting device according to claim 7, wherein the actuating shaft includes a terminal-end cavity shaped to receive the free end of the lead screw without contacting the free end.

9. An adjusting device according to claim 8, wherein the actuating body includes at least one radial projection that engage(s) in at least one axial groove defined in the support body and prevents the actuating body from rotating relative to the support body.

10. An adjusting device according to claim 9, further comprising a lead screw nut disposed in a cavity of the actuating body, the lead screw nut providing the inner thread of the actuating body, and wherein the first side of the first roller bearing is an inner bearing ring and the second side of the first roller bearing is an outer bearing ring.

11. A turbomachine, comprising:

a rotor having blades that are pivotable about respective pivot axes, a transmission configured to pivot the blades about the respective pivot axes, an axially-displaceable actuating shaft configured rotate together with the transmission and to actuate the transmission so as to cause the blades to pivot, and the adjusting device according to claim 10 configured to axially displace the actuating shaft.

12. A turbomachine according to claim 11, wherein the turbomachine is one of a pump, a compressor, a turbine and a turbine generator.

13. An adjusting device for blades of a rotor that includes a transmission for adjusting the blades, the transmission being actuatable by a co-rotating, axially-displaceable actuating shaft, the adjusting device including:

a first roller bearing having a first side configured to be attached to the actuating shaft and a second side connected with an actuating body, a support body supporting the actuating body in a non-rotatable manner, and a screw drive configured to axially displace the actuating body relative to the support body, wherein the actuating body includes an inner thread, a complementary thread of a lead screw engages the inner thread, the lead screw is rotatably supported at a bearing point of the support body, but is fixed in the axial direction, the lead screw includes a driven part to which a rotary drive is connectable, wherein the lead screw has a free end that projects into a recess defined in the support body.

14. An adjusting device according to claim 13, wherein the actuating shaft includes a cavity defined on a terminal end and shaped to receive the free end of the lead screw without contacting the free end.

15. An apparatus comprising:

a rotor having at least two blades, each blade being pivotable about a respective pivot axis that is perpendicular to a rotational axis of the rotor, a linear-to-rotational motion converter coupled to the blades and being configured to pivot the blades about their respective pivot axes, the linear-to-rotational motion converter being rotatable together with the rotor, an actuating shaft that is coaxial with the rotational axis and is configured to be linearly displaceable along the rotational axis while rotating together with the rotor and the linear-to-rotational motion converter, a roller bearing having a first bearing ring attached to the actuating shaft and a second bearing ring connected with an axially-displaceable actuating element, a stationary support element supporting the axially-displaceable actuating element in a non-rotatable manner, and a screw drive configured to axially displace the actuating element along the rotational axis relative to the support element, wherein the screw drive comprises an inner thread defined on the actuating element and a complementary outer thread defined on a lead screw that engages the inner thread, the lead screw being rotatably supported at a bearing point of the support element and being immovable in the axial direction, and wherein a motor is configured to rotatably drive the lead screw, the lead screw and the actuating shaft are aligned in series along the rotational axis, a free end of the lead screw projects into a recess defined in the support element, which is substantially hollow circular cylindrical-shaped, and a cavity is defined in a terminal end of the actuating shaft that faces the recess of the support element, the cavity being shaped to receive the free end of the lead screw without contacting the free end.

16. An apparatus according to claim 15, wherein the actuating element includes at least one radial projection that engage(s) in at least one axial groove defined in the support element and prevents the actuating element from rotating relative to the support element when the lead screw rotates.

17. An apparatus according to claim 16, wherein the lead screw is rotatably supported on the support element by one of a two-row tapered roller bearing, a spherical roller bearing and a pair of angular contact roller bearings disposed in a back-to-back arrangement.

18. An apparatus according to claim 17, wherein the linear-to-rotational motion converter comprises a crank affixed to a pivot axle of each blade and a connecting rod coupled to each crank, the connecting rods being linearly drivable by the actuating shaft.

* * * * *